US010563659B2

(12) United States Patent
Liu et al.

(10) Patent No.: US 10,563,659 B2
(45) Date of Patent: Feb. 18, 2020

(54) SERIES FAN STRUCTURE

(71) Applicant: ASIA VITAL COMPONENTS CO., LTD., New Taipei (TW)

(72) Inventors: Feng Liu, New Taipei (TW); Ze-Hua Tan, New Taipei (TW); Jing-Ping Huang, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 307 days.

(21) Appl. No.: 15/371,168

(22) Filed: Dec. 6, 2016

(65) Prior Publication Data

US 2018/0156229 A1 Jun. 7, 2018

(51) Int. Cl.

| | |
|---|---|
| ***F04D 19/00*** | (2006.01) |
| ***F04D 29/70*** | (2006.01) |
| ***F04D 29/54*** | (2006.01) |

(52) U.S. Cl.

CPC ..... *F04D 19/007* (2013.01); *F04D 29/541* (2013.01); *F04D 29/703* (2013.01)

(58) Field of Classification Search

CPC .... F04D 19/007; F04D 29/541; F04D 29/703; H05K 7/20327; H05K 7/20272; H05K 7/207; G06F 1/20; G06F 1/203; G06F 1/206

See application file for complete search history.

(56) References Cited

U.S. PATENT DOCUMENTS

| | | | | |
|---|---|---|---|---|
| 3,144,201 | A * | 8/1964 | Rundle | F04D 29/324 415/194 |
| 3,402,882 | A * | 9/1968 | Militello | F04D 29/703 415/121.2 |
| 7,909,902 | B2 * | 3/2011 | Eckberg | B01D 46/10 174/382 |
| 7,946,804 | B2 * | 5/2011 | Yoshida | F04D 29/542 415/199.5 |
| 7,946,805 | B2 * | 5/2011 | Yoshida | F04D 19/007 415/219.1 |
| 8,025,490 | B2 * | 9/2011 | Lee | F04D 19/007 415/199.4 |
| 8,079,801 | B2 * | 12/2011 | Yoshida | F04D 25/0613 415/199.5 |
| 8,133,006 | B2 * | 3/2012 | Yoshida | F04D 19/007 415/68 |

(Continued)

*Primary Examiner* — Patrick Hamo
*Assistant Examiner* — Joseph S. Herrmann
(74) *Attorney, Agent, or Firm* — Jackson IPG PLLC; Demian K. Jackson

(57) ABSTRACT

A series fan structure includes at least one first combining part and a series fan assembly, which has a first fan and a second fan mated with the first fan. The first fan has a first base and a lateral side, which together internally define a first passage. The first base is outwardly extended to form a plurality of a first supporting portions connected to the first lateral side. A first connecting space is defined among the first supporting portions and communicated with the first passage. The second fan has a second base and a lateral side, which together internally define a second passage, which is communicated with the first passage and the first connecting space. The first combining part is located in the first connecting space and connected to the first supporting portions and has a plurality of first holes communicated with the first and the second passage.

14 Claims, 9 Drawing Sheets

(56) References Cited

U.S. PATENT DOCUMENTS

| | | | | |
|---|---|---|---|---|
| 9,334,879 | B2 * | 5/2016 | Jun | F04D 25/0613 |
| 9,651,054 | B2 * | 5/2017 | Chang | F04D 29/023 |
| 10,267,339 | B2 * | 4/2019 | Sun | F04D 29/667 |
| 2009/0155104 | A1 * | 6/2009 | Takeshita | F04D 19/007<br>417/423.5 |

* cited by examiner

SERIES FAN STRUCTURE

FIELD OF THE INVENTION

The present invention relates generally to a series fan structure, and more particularly to a series fan assembly structure, which has better vibration absorption effect. Moreover, the series fan structure can provide higher air volume.

BACKGROUND OF THE INVENTION

As the advancement of technology, most people nowadays increasingly depend on various electronic devices; however, the electronic elements in the electronic devices, such as Personal Computers, Laptops, generate higher and higher heat during operation thereof to cause a greatly raised temperature inside the electronic devices. Yet the high temperature environment adversely affects the performance of the electronic elements and can even cause damage to the electronic elements. In order to keep the electronic device work normally, it is necessary to use a fan to maintain the electronic device at an optimal working temperature.

Please refer to FIG. 1, which is a perspective exploded view of a conventional series fan 1. The series fan 1 includes a fan frame 10, fan impeller 11, a fastening element 12, and a motor (not shown). As shown, all the fan frames 10 of the series fan 1 have the same size. The fan frame 10 is assembled with the fan impeller 11, the motor to combine into the fan. The fan tends to produce vibration during the operation thereof due to motor torque; in particular the series fan 1 is composed of two fans which are serially connected to each other. Conventionally, two fans are serially connected to each other with the fastening element 12, such as a clamping or a screwing structure.

Since the fans are axially connected to each other, and therefore, the vibration cannot be redacted. The vibration also brings noise and reduces the system stability. Moreover, two fan frames 10 generate a great amount of noise and resonance when the fan impellers 11 of the two fan frames 11 operate at the same time. In addition, the air is blown in one fan of the series fan 1 cannot be flow out of the other fan of the series fan 1 since they are serially connected when operation, so as to have low air volume.

According to the above, the conventional series fan has the following shortcomings: (1). the vibration absorption effect is poor; (2). more noise is made due to poor vibration effect; and (3). incapable of providing higher air volume.

It is therefore tried by the inventor to develop an improved series fan structure to overcome the drawbacks and problems in the conventional series fan structure.

SUMMARY OF THE INVENTION

To solve the above and other problems, a primary object of the present invention is to provide a series fan structure that can have better vibration absorption effect.

Another object of the present invention is to provide a series fan structure that can provide higher air volume.

To achieve the above and other objects, the series fan structure includes at least one first combining part and a series fan assembly, which has a first fan and a second fan mated with the first fan. The first fan has a first base and a lateral side, which together internally define a first passage. The first base is outwardly extended to form a plurality of a first supporting portions connected to the first lateral side. A first connecting space is defined among the first supporting portions and communicated with the first passage. The second fan has a second base and a lateral side, which together internally define a second passage, which is communicated with the first passage and the first connecting space. The first combining part is located in the first connecting space and connected to the first supporting portions and has a plurality of first holes communicated with the first and the second passage.

With the first combining part located in the first connecting space and a plurality of first holes in the first combining part, the series fan structure can have better vibration absorption effect and can provide higher air volume.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
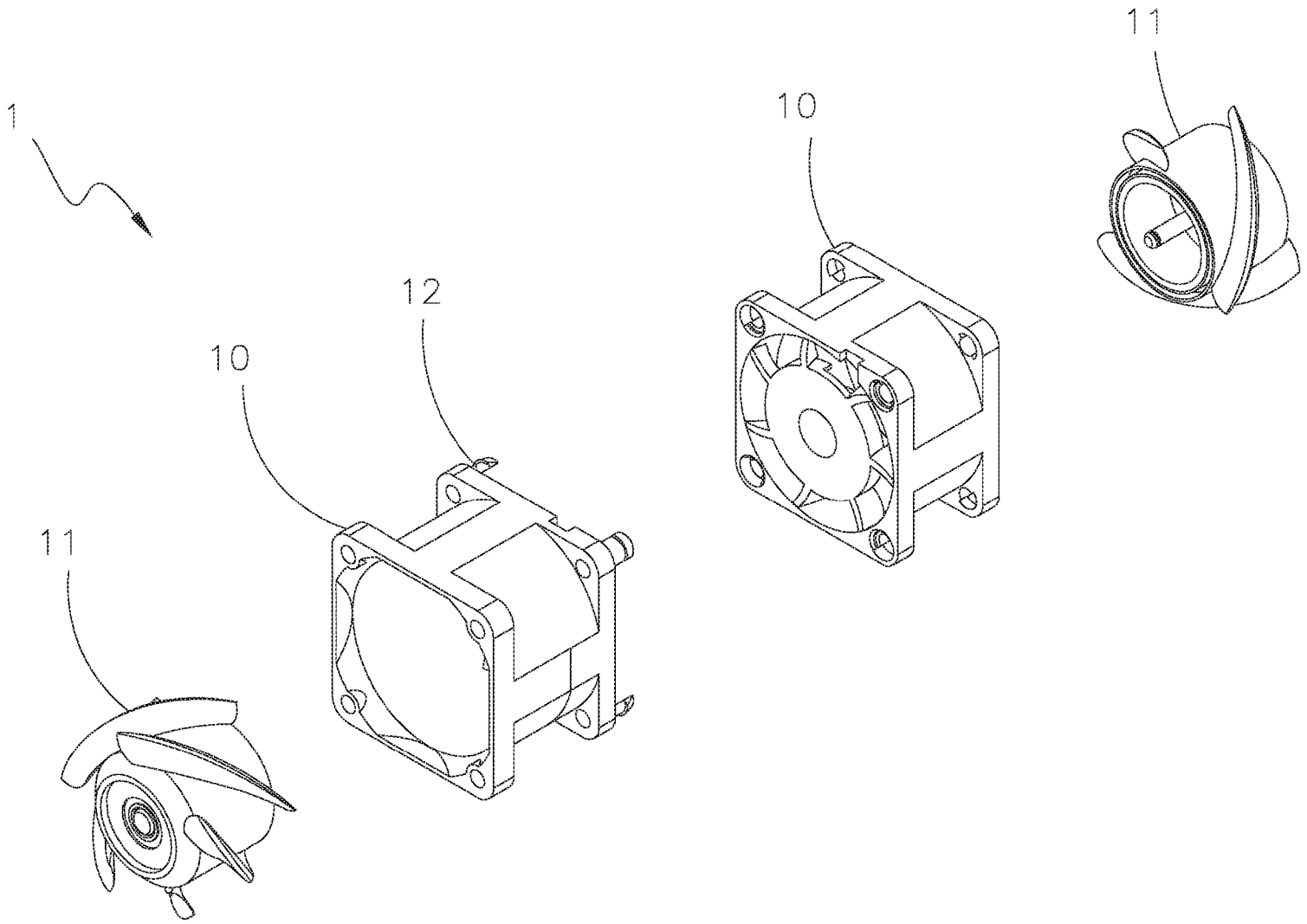
(prior art) Fig. 1
FIG. 1 is a perspective exploded view of a conventional series fan.

The present invention will now be described with some preferred embodiments thereof and by referring to the accompanying drawings. For the purpose of easy to understand, elements that are the same in the preferred embodiments are denoted by the same reference numerals.

Figure 2:
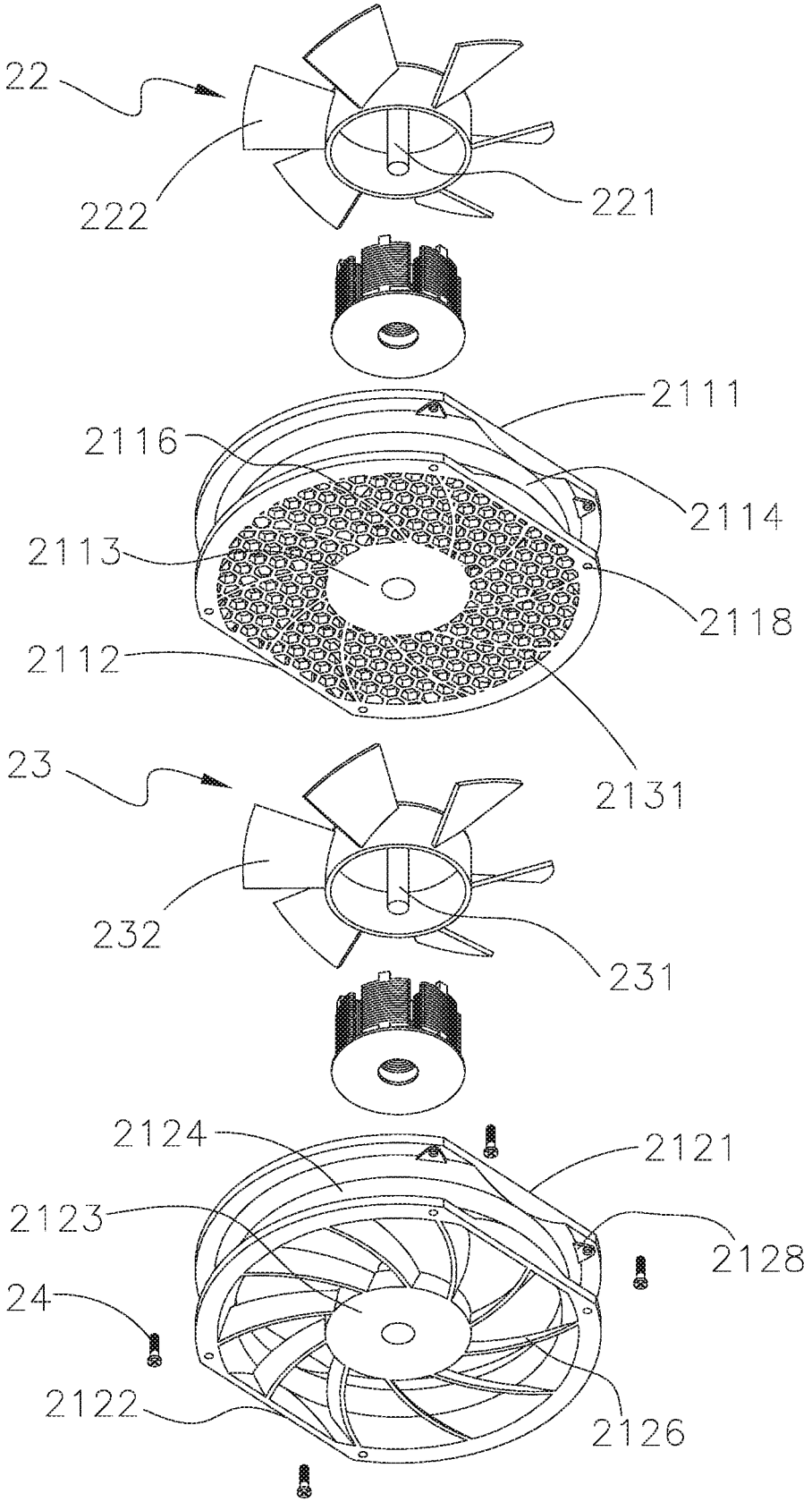
FIG. 2 is a perspective exploded view of a first embodiment of the present invention.
Figure 3:
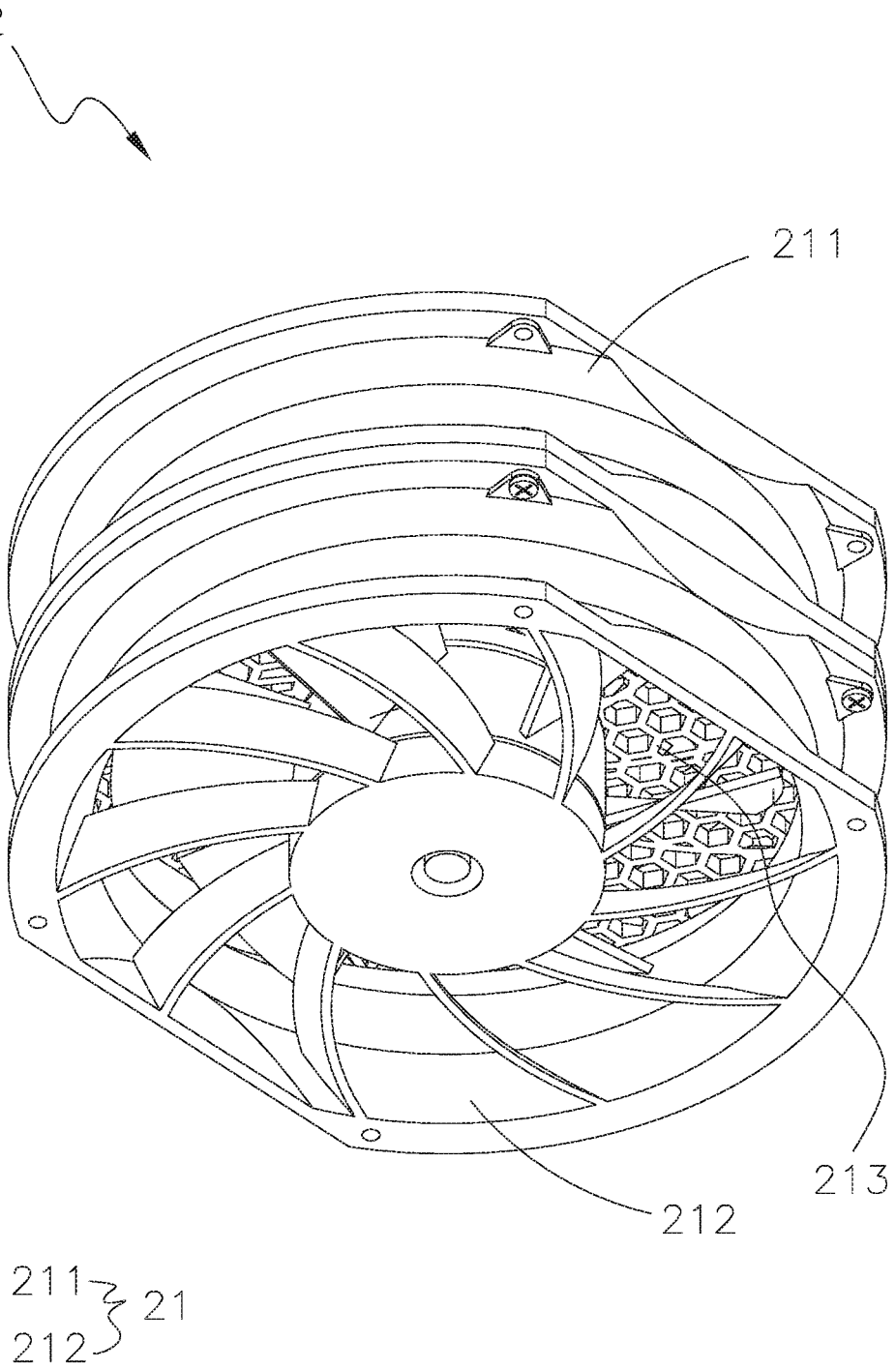
FIG. 3 is a perspective assembled view of the first embodiment of the present invention.
Figure 4:
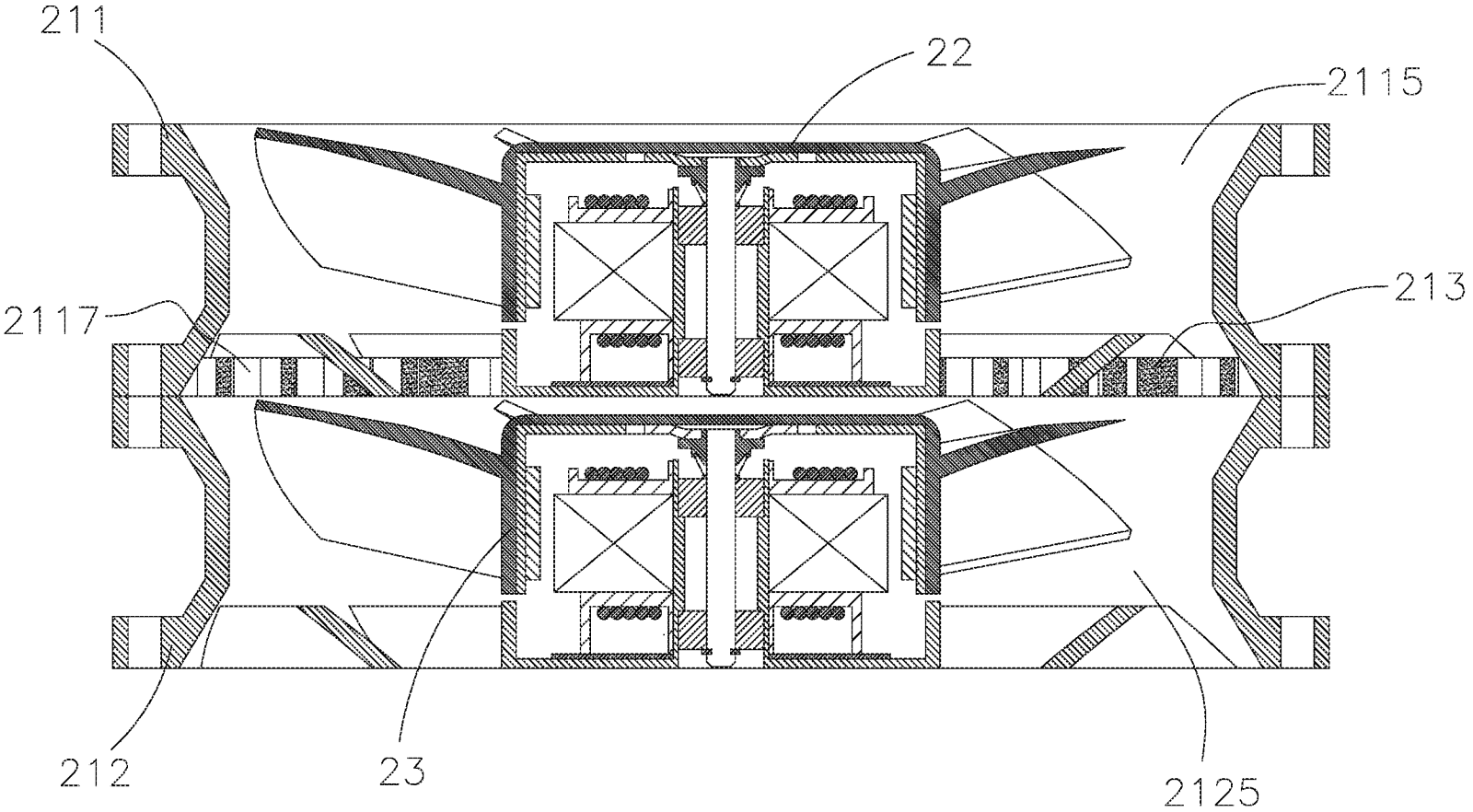
FIG. 4 is an assembled sectional view of a second embodiment of the present invention.

Please refer to FIGS. 2 to 4, which are exploded and assembled perspective views, and assembled sectional view, respectively, of a series fan structure 2 according to a first embodiment of the present invention. As shown, the series fan structure 2 includes at least one first combining part 213 and a series fan assembly 21, which has a first fan 211 and a second fan 212 serially connected to the first fan 211. A plurality of fixing portions 2118 are provided on a periphery of the first fan 211, whereas a plurality of connecting portions 2128 are provided on a periphery of the second fan 212. The fixing portions 2118 of the first fan 211 are correspondingly connected to the connecting portions 2128 of the second fan 212. A plurality of fixing members 24 are respectively extended through the fixing portions 2118 of the first fan 211 and the connecting portions 2128 of the second fan 212 to combine the first and the second fan 211, 212. In the illustrated first embodiment, the fixing members 24 can be, for example but not limited to, screws; however, they can be screws, rivets, or other fastening elements in practical implementation. Moreover, the first and the second fan 211, 212 are serially connected to each other by screwing.

However, the first and the second fan 211, 212 can be connected to each other in a way of clamping, snap-fitting, press-fitting, or bonding.

The first fan 211 has a first base 2113 and a lateral side 2114, which together internally define a first passage 2115. The first base 2113 is outwardly extended to form a plurality of a first supporting portions 2116 connected to the first lateral side 2114. A first connecting space 2117 is defined among the first supporting portions 2116 and communicated with the first passage 2115. The first fan 211 has a first air inlet 2111 and a first air outlet 2112, which are communicated with the first passage 2115, and the first base 2113 is formed on the first air outlet 2112. A first rotor blade unit 22 is received in the first passage 2115, which has a first shaft 221 and a plurality of fan blades 222, the first shaft 221 has one end assembled into the first base 2113.

The second fan 212 has a second base 2123 and a lateral side 2124, which together internally define a second passage 2125, which is communicated with the first passage 2115 and the first connecting space 2117. The second fan 212 has a second air inlet 2121 and a second air outlet 2122, which are communicated with the second passage 2125, and the second base 2123 is formed on the second air outlet 2122. A second rotor blade unit 23 is received in the second passage 2125, which has a second shaft 231 and a plurality of fan blades 232, the second shaft 231 has one end assembled into the second base 2123.

The first combining part 213 is located in the first connecting space 2117 and connected to the first supporting portions 2116 and has a plurality of first holes 2131 communicated with the first and the second passage 2115, 2125. The first hole 2131 can be, for example but not limited to, round-shaped, hexagon head, or other configurations. In addition, no matter what the shape of the first hole 2131 is, it can provide the same effect and is a vertical or slant passage. Moreover, In the illustrated first embodiment, the first combining part 213 is integrally formed with the first base 2113, the first lateral side 2114, and the first supporting portions 2116. That is, the first combining part 213 is injected onto the first fan 211.

With these arrangements of the first combining part 213, the first air outlet 2112 of the first fan 211 is mately connected with the second air inlet 2121 of the second fan 212 to combine into the series fan structure 2. When the series fan structure operates, the air flow is blown in the first passage 2115 via the first air inlet 2111, and then to the first holes 2131 of the second passage 2125 via the first combining part 213. After that, the air flow is vented out via the second air outlet 2122, such that the problems of vibration the conventional series fans have due to resonance can be solved. Moreover, the great amount of noise the vibration causes can also be greatly reduced. Furthermore, with the first holes 2131 of the first combining part 213, the air flow can be rectified and then vented out of the series fan structure 2 to increase higher air volume.

Figure 5:
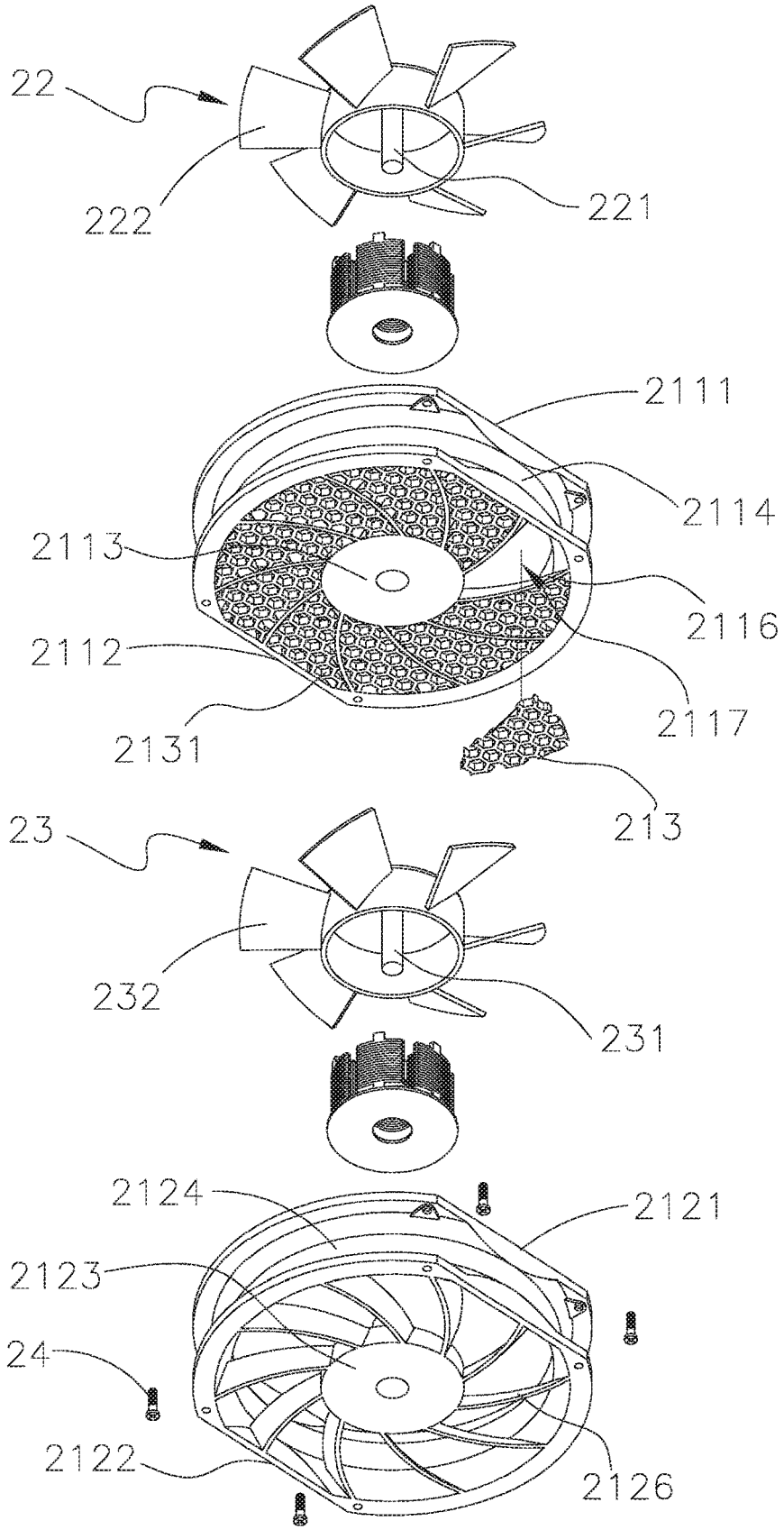
FIG. 5 is a perspective exploded view of the second embodiment of the present invention.

Please refer to FIG. 5, which is an exploded perspective view of the series fan 2 according to a second embodiment of the present invention. The second embodiment of the series fan structure 2 is generally structurally similar to the first embodiment except that, in this second embodiment, the first combining part 213 is a first waveguide board, which is correspondingly located in the first connecting space 2117. In other words, the difference between the first and the second embodiment is that the first combining part 213 is a single element, and the first waveguide board is located in the first connecting space 2117 in a way of press-fitting, snap-fitting, or bonding.

Figure 6:
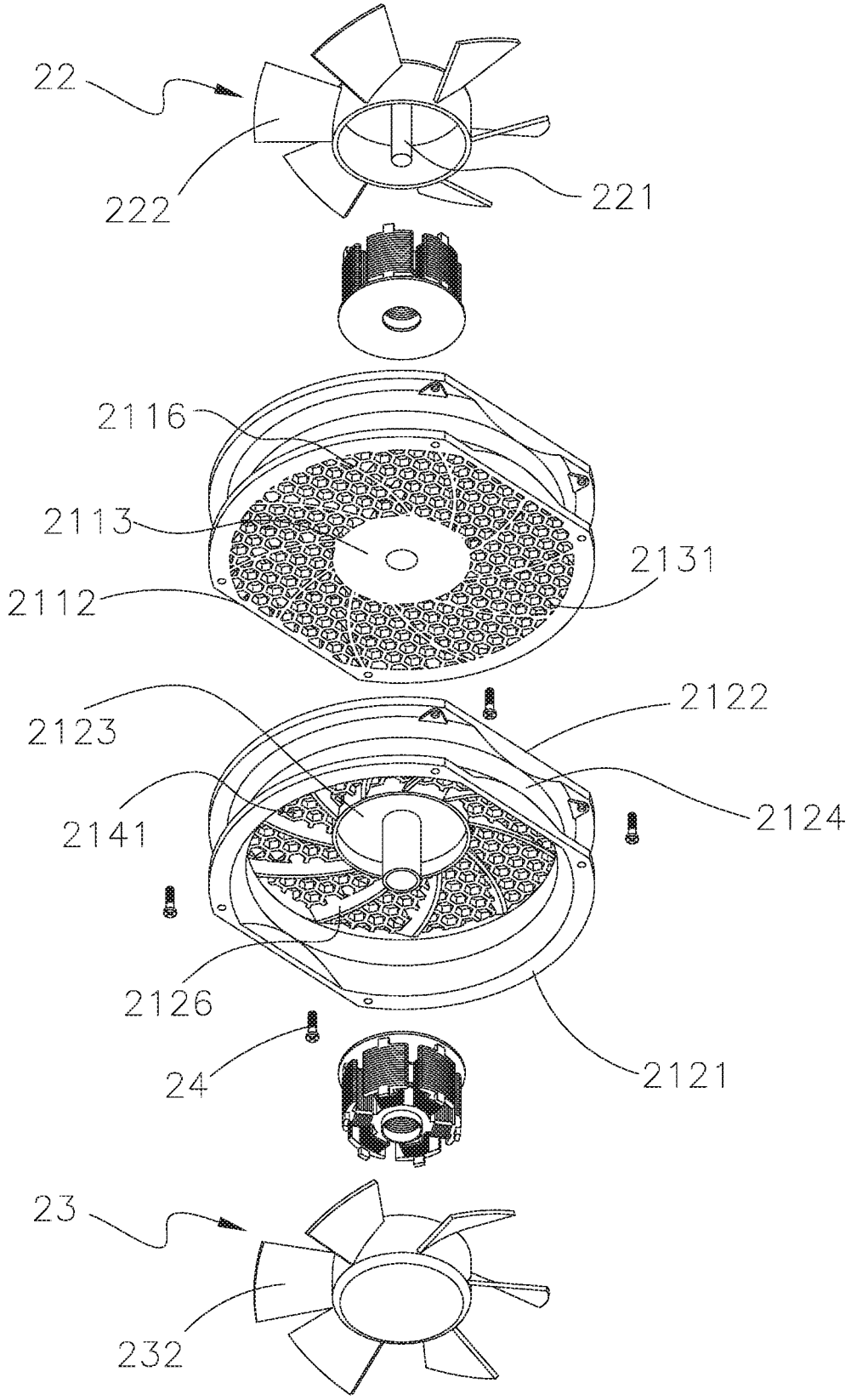
FIG. 6 is a perspective exploded view of a third embodiment of the present invention.
Figure 7:
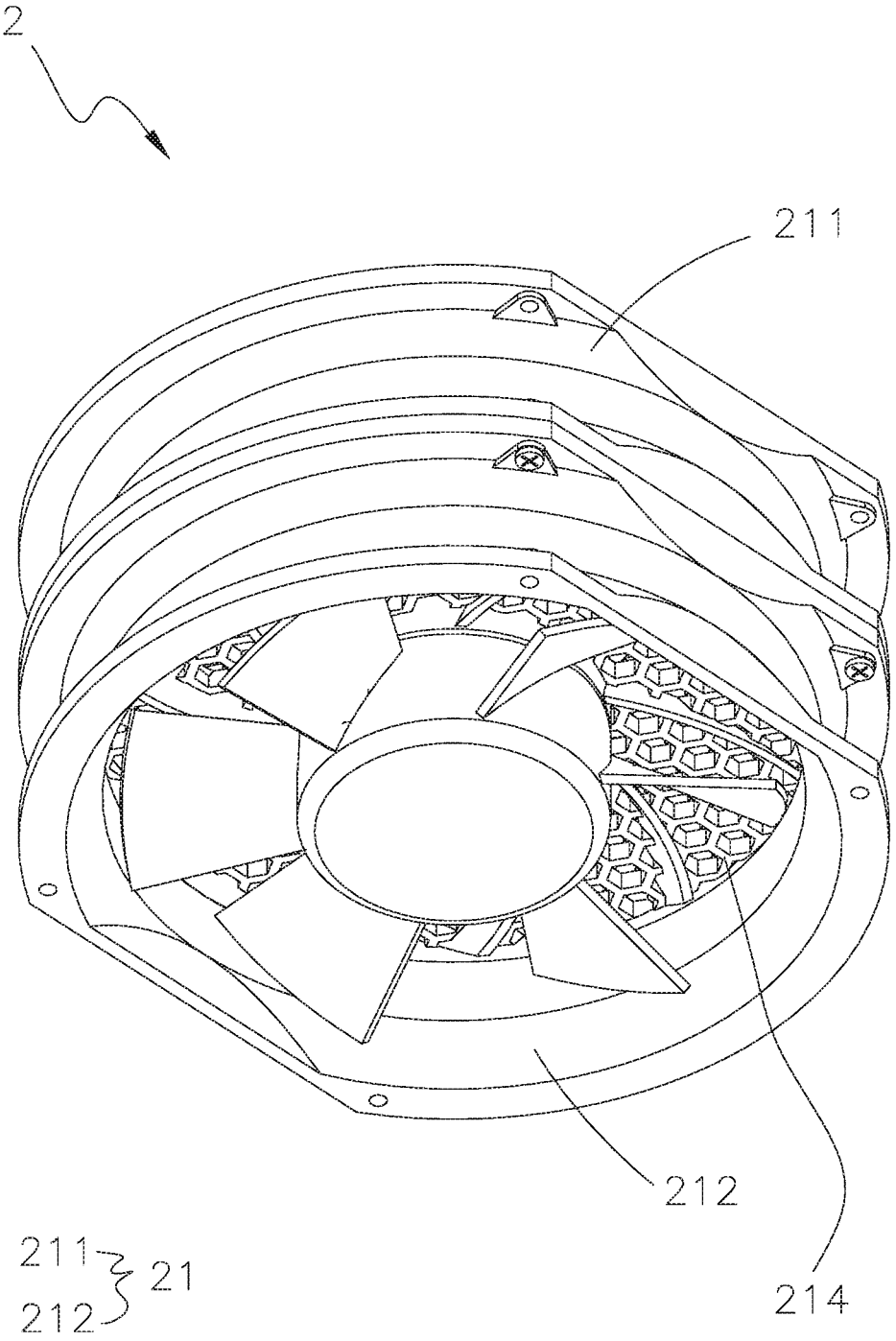
FIG. 7 is a perspective assembled view of the third embodiment of the present invention.
Figure 8:
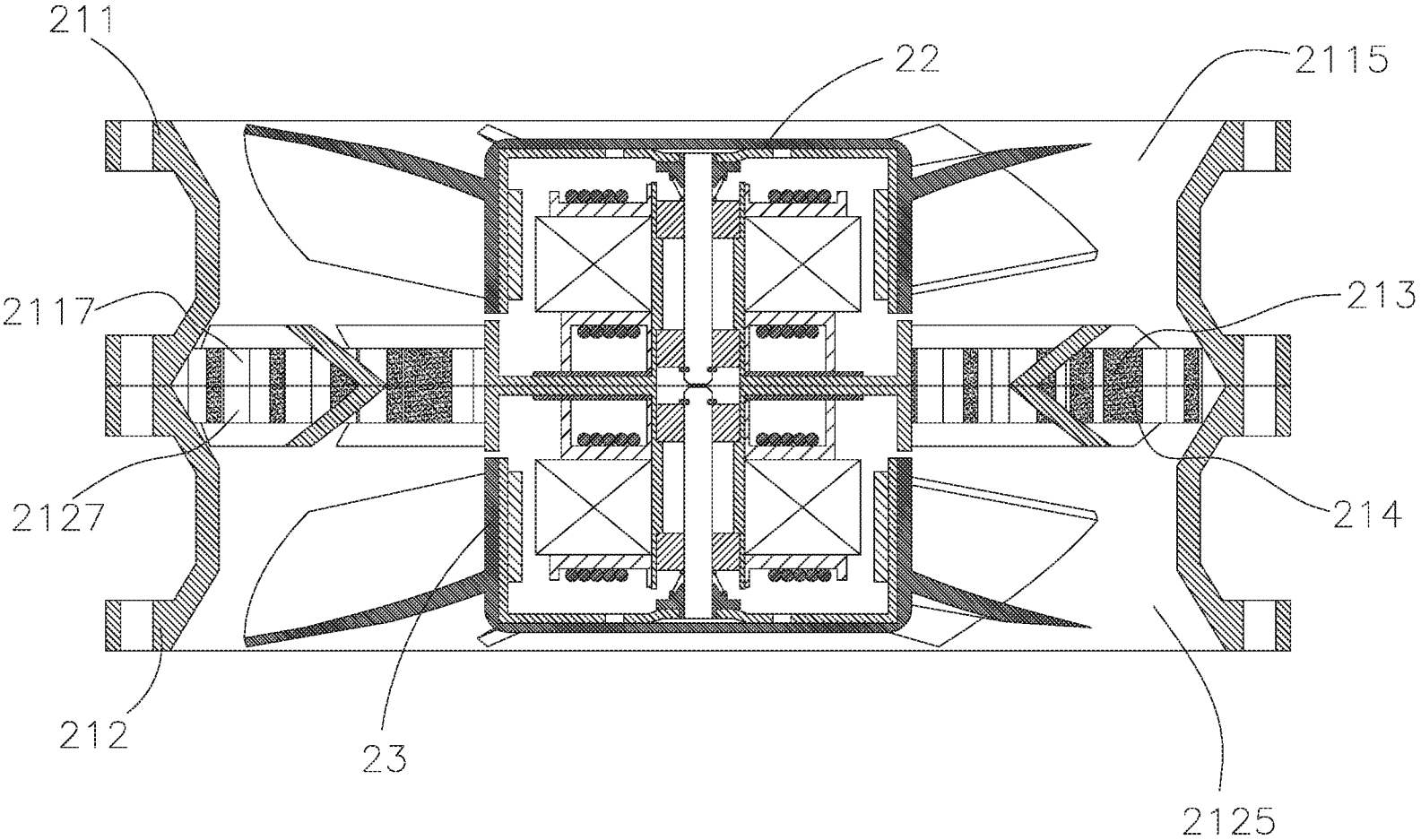
FIG. 8 is an assembled sectional view of the third embodiment of the present invention.

Please refer to FIGS. 6 to 8, which are exploded and assembled perspective views, and assembled sectional view, respectively, of a series fan structure 2 according to a third embodiment of the present invention. The third embodiment of the series fan structure 2 is generally structurally similar to the first two embodiments except that, in this third embodiment, the second base 2123 is outwardly extended to form a plurality of a second supporting portions 2126 connected to the second lateral side 2124. A second connecting space 2127 is defined among the second supporting portions 2126 and communicated with the second passage 2125. At least one second combining part 214 is located in the second connecting space 2127 and connected to the second supporting portions 2126 and has a plurality of second holes 2141 communicated with the first and the second passage 2115, 2125. The second hole 2141 can be, for example but not limited to, round-shaped, hexagon head, or other configurations. In addition, no matter what the shape of the second hole 2141 is, it can provide the same effect and is a vertical or slant passage.

In the illustrated third embodiment, the second combining part 214 is integrally formed with the second base 2123, the second lateral side 2124, and the second supporting portions 2126. Furthermore, the first air outlet 2112 of the first fan 211 is mately connected with the second air outlet 2112 of the second fan 212 to combine into the series fan structure 2. However, though the way to serially connect the first fan 211 to the second fan 212 is different from the first embodiment, the series fan structure 2 can also provide the same effect, which is greatly reducing a great amount of noise due to resonance and can increase higher air volume.

Figure 9:
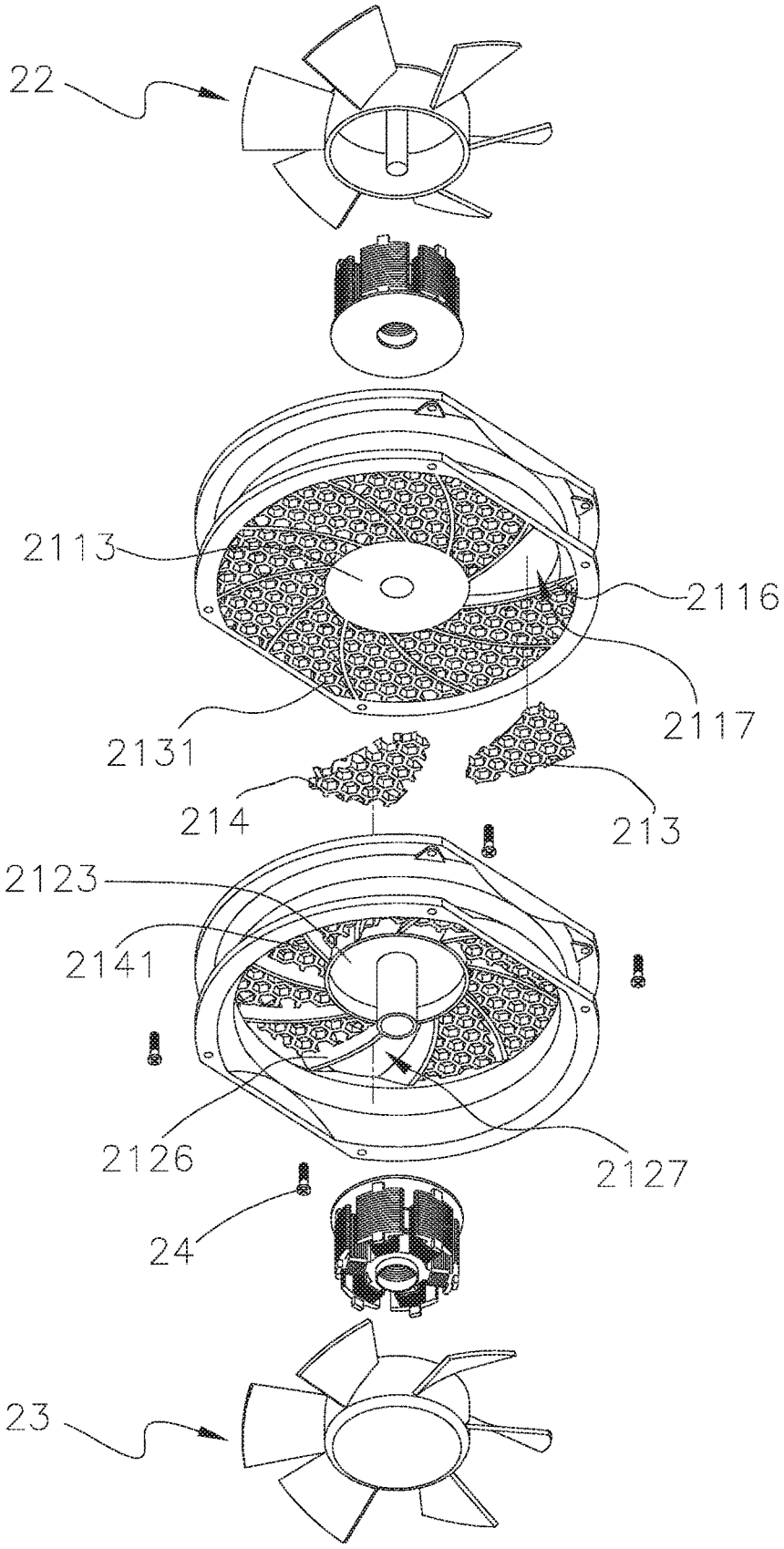
FIG. 9 is a perspective exploded view of a fourth embodiment of the present invention.

Please refer to FIG. 9, which is an exploded perspective view of the series fan 2 according to a second embodiment of the present invention. The fourth embodiment of the series fan structure 2 is generally structurally similar to the first three embodiments except that, in this fourth embodiment, the second combining part 214 is a second waveguide board, which is correspondingly located in the second connecting space 2117. In other words, the difference between the first three embodiments and the fourth embodiment is that the second combining part 214 is a single element, and the second waveguide board is located in the second connecting space 2127 in a way of press-fitting, snap-fitting, or bonding.

According to the above arrangements, in comparison with the conventional device, the present invention has the following advantages:

(1) having better vibration absorption effect; (2) having great noise-reduced effect; and (3) being able to provide higher air volume.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A series fan structure comprising:

a series fan assembly having a first fan and a second fan mated with the first fan;

the first fan having a first base and a first lateral side together defining a first airflow passage, the first base is outwardly extended to form a plurality of first supporting portions connected to the first lateral side, a first connecting space being defined among the plurality of first supporting portions;

the second fan having a second base and a second lateral side together defining a second airflow passage;

a first combining part located in the first connecting space and connected to the plurality of first supporting portions and having a plurality of first holes connecting the first airflow passage and the second airflow passage; and the plurality of first holes are arrayed laterally between the first base and the first lateral side.

2. The series fan structure as claimed in claim 1, wherein the first combining part is integrally formed with the first base, the first lateral side, and the plurality of first supporting portions.

3. The series fan structure as claimed in claim 1, wherein the first combining part is a first waveguide board, which is correspondingly located in the first connecting space.

4. The series fan structure as claimed in claim 3, wherein the first waveguide board is located in the first connecting space in a way selected from the group consisting of press-fitting, snap-fitting, and bonding.

5. The series fan structure as claimed in claim 1, wherein the first fan has a first air inlet and a first air outlet in airflow communication with the first airflow passage, and the first base being formed on the first air outlet, whereas the second fan has a second air inlet and a second air outlet in airflow communication with the second airflow passage, and the second base being formed on the second air outlet.

6. The series fan structure as claimed in claim 1, wherein the plurality of first holes have a configuration selected from the group consisting of round-shaped and hexagon head-shaped and define an axial airflow passage or a slant airflow passage.

7. The series fan structure as claimed in claim 1, wherein the second base is outwardly extended to form a plurality of second supporting portions connected to the second lateral side and a second connecting space being defined among the plurality of second supporting portions.

8. The series fan structure as claimed in claim 7, wherein a second combining part is located in the second connecting space and connected to the plurality of second supporting portions and having a plurality of second holes connecting the first airflow passage and the second airflow passage; and the plurality of second holes are arrayed laterally between the second base and the second lateral side.

9. The series fan structure as claimed in claim 8, wherein the second combining part is integrally formed with the second base, the second lateral side, and the plurality of second supporting portions.

10. The series fan structure as claimed in claim 8, wherein the second combining part is a second waveguide board, which is correspondingly located in the second connecting space.

11. The series fan structure as claimed in claim 10, wherein the second waveguide board is located in the second connecting space in a way selected from the group consisting of press-fitting, snap-fitting, and bonding.

12. The series fan structure as claimed in claim 8, wherein the plurality of second holes have a configuration selected from the group consisting of round-shaped and hexagon head-shaped and define an axial airflow passage or a slant airflow passage.

13. The series fan structure as claimed in claim 1, wherein the first fan and the second fan are serially mated with each other by screwing.

14. The series fan structure as claimed in claim 1, wherein a first rotor blade unit is received in the first airflow passage, which has a first shaft and a plurality of fan blades; the first shaft has one end assembled into the first base; and a second rotor blade unit is received in the second airflow passage, which has a second shaft and a plurality of fan blades; the second shaft has one end assembled into the second base.

* * * * *